US007501549B2

(12) United States Patent
Podrebarac et al.

(10) Patent No.: US 7,501,549 B2
(45) Date of Patent: Mar. 10, 2009

(54) BENZENE REMOVAL FROM FCC NAPHTHA

(75) Inventors: Gary G. Podrebarac, Houston, TX (US); Richard Foley, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 396 days.

(21) Appl. No.: 11/544,172

(22) Filed: Oct. 6, 2006

(65) Prior Publication Data

US 2008/0086020 A1 Apr. 10, 2008

(51) Int. Cl.
*C07C 7/04* (2006.01)
*C10G 45/02* (2006.01)

(52) U.S. Cl. ..... 585/804; 585/809; 585/810; 208/211; 208/212; 208/213

(58) Field of Classification Search ..... 208/210, 208/211, 212, 213; 585/804, 809, 810
See application file for complete search history.

(56) References Cited

U.S. PATENT DOCUMENTS 3,400,469 A * 9/1968 Janett ..... 34/116
3,406,217 A * 10/1968 Davison et al. ..... 585/253
5,536,886 A 7/1996 Tamminen et al.
6,369,280 B1 4/2002 Tamminen et al.
6,444,118 B1 * 9/2002 Podrebarac et al. ..... 208/210
2004/0055933 A1 * 3/2004 Groten et al. ..... 208/57
2005/0082201 A1 4/2005 Groten et al.
2006/0183952 A1 8/2006 Judzis et al.

OTHER PUBLICATIONS

Notification of Transmittal of the International Search Report and the Written Opinion of the International Searching Authority, or the Declaration dated Feb. 28, 2008 pp. 10.

* cited by examiner

*Primary Examiner*—Tam M Nguyen
(74) *Attorney, Agent, or Firm*—Osha Liang LLP

(57) ABSTRACT

An integrated process for the isolation of benzene contained within a fluid catalytically cracked naphtha is disclosed wherein a $C_6$ fraction containing a benzene concentrate is subjected to etherification with alcohol (e.g. methanol and/or ethanol) to convert the $C_6$ isoolefins to ethers which are separated by fractional distillation. If desired the ethers may be dissociated to the isoolefins and alcohol. The remaining material in the benzene concentrate may then be treated to remove olefins and organic sulfur compounds so that the benzene may be removed by solvent extraction. Alternatively the benzene in the remaining material may be subjected to hydrogenation.

12 Claims, 2 Drawing Sheets

BENZENE REMOVAL FROM FCC NAPHTHA

BACKGROUND OF THE INVENTION

1. Field of the Invention

The present invention relates to a process for the isolation and removal of benzene from a fluid catalytically cracked naphtha. More particularly the invention relates to a process wherein benzene is first concentrated in a $C_6$ fraction and the $C_6$ fraction subjected to etherification to preserve the isoolefins during subsequent benzene removal steps.

2. Related Information

Benzene, while being a useful commodity chemical, is a toxic component of gasoline. Consequently many countries have laws that limit its concentration in gasoline to about one percent. To meet these current limits some refiners need to produce reformate which is low in benzene content. This can be done by removing benzene precursors from the reformer feed or by hydrogenation of the benzene in the reformer product. Another method is to remove the benzene by solvent extraction. However, if benzene limits continue to be reduced, the benzene in the fluid catalytically cracked (FCC) naphtha may need to be removed. Catalytically cracked naphtha gasoline boiling range material currently forms a significant part (≈⅓) of the gasoline product pool in the United States and it contains about 1.5% benzene.

Removing benzene from FCC naphtha streams is difficult because the benzene is accompanied by many close boiling olefins and sulfur compounds. A benzene rich fraction may be isolated by fractionation. Extraction of benzene from either a concentrate or the full naphtha stream would require complete saturation of the olefins present (i.e., a Bromine Index of less than 500) which would be very detrimental to the octane of the naphtha. An alternative to extraction would be hydrogenating the benzene in either the full stream or a benzene concentrate. If a full boiling range FCC naphtha were subjected to this treatment, the hydrogen consumption and the octane loss would be extremely high. Ideally only the $C_6$ fraction would be subject to this treatment. However, even treating this fraction would result in high hydrogen consumption and loss of octane.

In addition to benzene, sulfur must be lowered to meet stricter limitations. Hydrogenating organic sulfur compounds to only about 0.1 wppm sulfur, is similarly detrimental to the olefins.

The present invention addresses all of these concerns by removing benzene and sulfur while preserving the octane component of the olefins.

SUMMARY OF THE INVENTION

Briefly, the present invention is an integrated process for the isolation of benzene in a fluid catalytically cracked naphtha stream containing benzene, $C_6$ olefins and $C_6$ isoolefins comprising the steps of:

(a) separating a benzene concentrate fraction containing benzene and the $C_6$ olefins and $C_6$ isoolefins from the naphtha stream;

(b) subjecting the benzene concentrate stream to etherification with an alcohol, preferably over an etherification catalyst to convert the $C_6$ isoolefins to ethers; and (c) separating the ethers of $C_6$ isoolefins from the benzene concentrate.

In the present invention a $C_6$ fraction (a benzene concentrate) from an FCC naphtha, which contains in addition to benzene, olefins, alkanes and organic sulfur compounds boiling in the $C_6$ fraction range, is subjected to etherification to react the isoolefins with an alcohol or mixtures of alcohols, preferably a mono hydric alcohol having less than 6 carbon atoms, more preferably methanol or ethanol, to produce an ether of $C_6$ isoolefins which can be easily separated from the remainder of the $C_6$ fraction, for example by fractionation. Mixtures of alcohols can be used. Typically about one half of the $C_6$ olefins in a FCC naphtha are isoolefins. The ethers may be used directly as a gasoline blending component or dissociated back to the olefin and alcohol if ether limitations in the gasoline are critical.

The remaining $C_6$ fraction containing the benzene may then be subjected to hydrotreating to saturate the remaining olefins (predominately non isoolefins) and remove the organic sulfur (thiophenes) which would allow benzene to be recovered by solvent extraction, such as with triethylene glycol (UDEX®) or SULFOLANE®. Alternatively, the severity of the hydrotreating may be adjusted such that the benzene is completely hydrogenated along with the remaining olefins and organic sulfur compounds.

In a preferred embodiment the etherification is carried out at least in part by reactive distillation. In this embodiment, a greater degree of conversion of the isoolefins is obtained than in straight pass type reactions, since etherification of $C_6$ isoolefins is strongly limited by equilibrium.

For the purposes of the present invention, the term "catalytic distillation" includes reactive distillation and any other process of concurrent reaction and fractional distillation in a column, i.e., a distillation column reactor, regardless of the designation applied thereto and a "fixed bed" reactor also known as single pass reactor is one in which the reactants and products pass through the reactor in the nature of a plug flow without distillation.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure.

DETAILED DESCRIPTION OF THE PREFERRED EMBODIMENT

Figure 1:
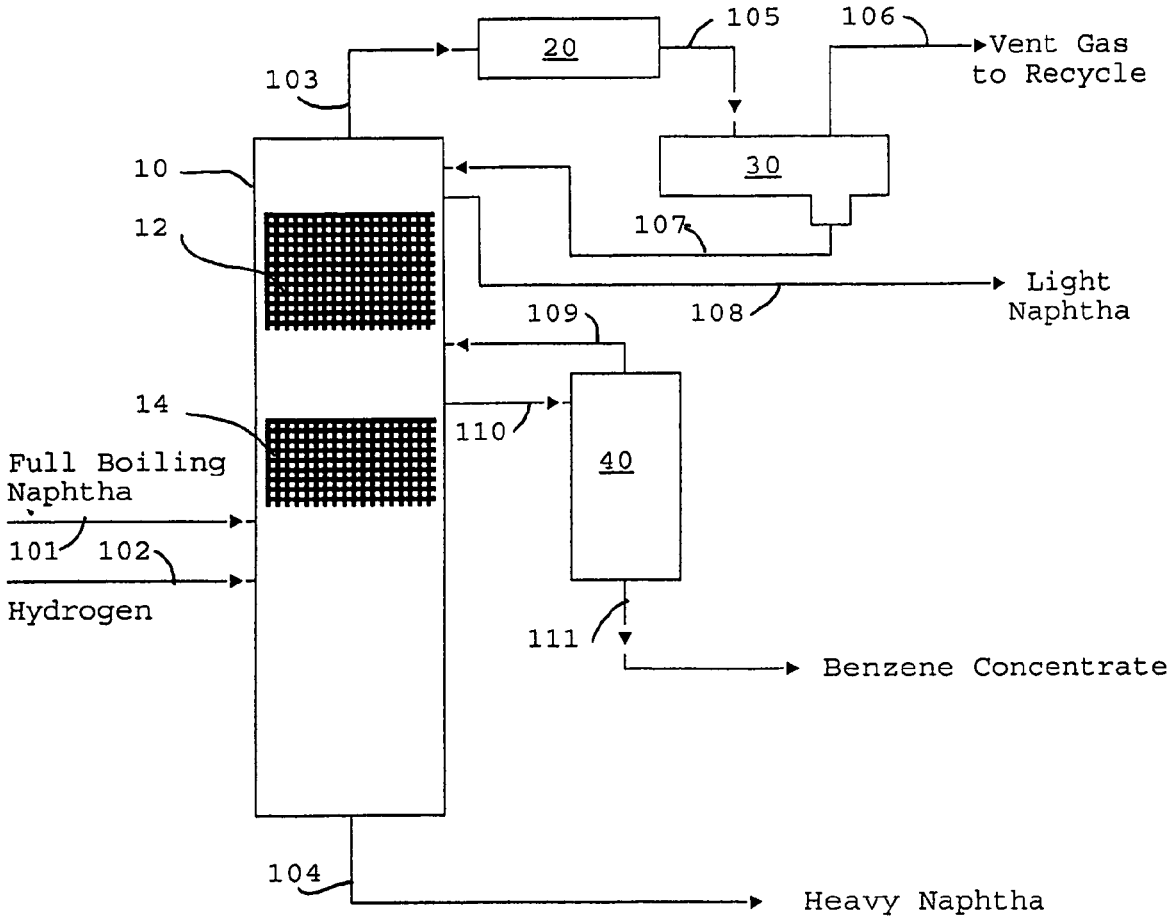
FIG. 1 is a simplified flow diagram in schematic form of a process for separating the benzene concentrate from the full boiling range FCC naphtha for use as the feed to the etherification.

Mixed refinery streams often contain a broad spectrum of olefinic compounds. This is especially true of products from either catalytic cracking or thermal cracking processes. Refinery streams are usually separated by fractional distillation, and because they often contain compounds that are very close in boiling points, such separations are not precise. A $C_6$ cut, for instance, may contain $C_5$'s and up to $C_8$'s. These components may be saturated (alkanes), unsaturated (monoolefins), or poly-unsaturated (diolefins). Additionally, the components may be any or all of the various isomers of the individual compounds. Typically a full boiling range FCC naphtha contains sulfur compounds along with the benzene which must also be removed. While there are many ways to remove the sulfur and fractionate the FCC naphtha it is particularly useful to combine the processes (i.e., distillation and sulfur removal). One such process using catalytic distillation is disclosed in U.S. Pat. No. 6,444,118, which employs a reactive distillation is incorporated herein by reference.

Preferably the etherification process has a reactive distillation etherification step to obtain a high conversion of the $C_6$ isoolefins. Also in the distillation process for obtaining a benzene concentrate for the etherification a reactive distillation is preferred. The advantages of catalytic distillation have become known over the past several years. The success of catalytic distillation lies in an understanding of the principles associated with distillation. First, because the reaction is occurring concurrently with distillation, the initial reaction product is removed from the reaction zone as quickly as it is formed. Second, because the reaction mixture is boiling, the temperature of the reaction is controlled by the boiling point of the mixture at the system pressure. The heat of the reaction creates more boil up, but no increase in temperature.

As a result, a great deal of control over the rate of reaction and distribution of products can be achieved by regulating the system pressure. Also, adjusting the throughput (residence time=LHSV, which means the liquid volume of hydrocarbon per volume of catalyst per hour) gives further control of product distribution and degree of conversion. The temperature in the reactor is determined by the boiling point of the liquid mixture present at any given pressure. The temperature in the lower portions of the column will reflect the constitution of the material in that part of the column, which will be higher than the overhead; that is, at constant pressure a change in the temperature of the system indicates a change in the composition in the column.

To change the temperature the pressure is changed. Temperature control in the reaction zone is thus controlled by the pressure; by increasing the pressure, the temperature in the system is increased, and vice versa.

In the present process, pressures of 1 to 50 atmospheres may be used to great effect. Depending on the pressure, temperatures in the range of 150 to 300° C. will be observed in the column reactor.

Another advantage, as noted above, is that a condensing liquid reactant occludes a gaseous reactant (such as hydrogen)which perchance improves catalytic contact and lowers the necessary partial pressure of the occluded gaseous reactant.

The fixed bed etherification reactor is preferably operated as a "boiling point reactor" as described in U.S. Pat. No. 4,950,803 which is incorporated herein by reference. That is, the pressure of the fixed bed reactor is adjusted such that the reaction mixture is boiling. This conveniently removes the heat produced by the exothermic reaction as latent heat of vaporization aiding in preventing an increase in the temperature.

The unreacted alcohol is removed, if desired, from the other unreacted material in the overheads from the distillation column reactor by water washing and subsequent distillation of the alcohol water mixture. The recovered alcohol may be recycled to the fixed bed reactor and the water to the water wash.

U.S. Pat. Nos. 5,003,124 and 4,950,803 disclose a liquid phase process for the etherification of $C_4$ and $C_5$ isoolefins with $C_1$ to $C_6$ alcohols in a boiling point fixed bed reactor that is controlled at a pressure to maintain the reaction mixture at its boiling point which may be directly attached to a catalytic distillation reactor.

The catalytic distillation process employs a catalyst system (See U.S. Pat. Nos. 4,215,011 and 4,302,356) which provides for both reaction and distillation concurrently in the same reactor, at least in part within the catalyst system. The method involved is briefly described as one where concurrent reaction and distillation occur in a combination reactor-distillation structures. Catalytic distillation structures useful for this purpose are disclosed in U.S. Pat. Nos. 4,731,229, 5,073,236, 5,431,890, 5,266,546 and 5,730,843 which are incorporated by reference. The preferred structure embodiment is described in U.S. Pat. No. 5,431,890 which is hereby incorporated by reference.

For example, in a preferred embodiment this system and procedure, $C_{1-2}$ alcohol, and isoolefin (or the stream from the boiling point reactor which contains, ether, some unreacted isoolefin and methanol or make up methanol) containing stream is continuously fed to the reactor/distillation column where they are contacted in the catalytic distillation structure. The $C_{1-2}$ alcohol preferentially reacts with isoolefin, forming ethers with the isoolefins which are heavier than the $C_5$ and $C_6$ components of the feed and the alcohol, hence it drops in the column to form the bottoms. Concurrently, the unreacted isoolefins and no isoolefins (e.g., n-pentane, n-pentenes, -hexane and n-hexenes) are lighter and form an overhead with the benzene concentrate while the ethers are collected from the lower portion of the column.

The present integrated process may be more specifically described as an integrated process for the isolation of benzene in a fluid catalytically cracked naphtha stream containing benzene, thiophene, mercaptans, diolefins, $C_6$ olefins and $C_6$ isoolefins comprising the steps of:

(a) separating a benzene concentrate stream containing benzene, thiophene, $C_6$ olefins and $C_6$ isoolefins from the fluid catalytically cracked naphtha stream by fractional distillation;

(b) feeding the benzene concentrate stream and methanol to a single pass fixed bed reactor containing an etherification catalyst wherein a portion of the $C_6$ isoolefins are reacted with $C_{1-2}$ alcohol to form C6 isoolefin ethers;

(c) feeding the effluent from the single pass fixed bed reactor to a distillation column reactor containing a bed of etherification catalyst;

(d) concurrently in the distillation column reactor;

(i) reacting substantially all of the unreacted $C_6$ isoolefins in the effluent with methanol or ethanol to form a reaction mixture containing ethers of $C_6$ isoolefins, unreacted $C_{1-2}$ alcohol, and reacted benzene concentrate; and (ii) separating the ethers of $C_6$ isoolefins from unreacted $C_{1-2}$ alcohol and unreacted benzene concentrate by fractional distillation;

(e) removing the ethers of $C_6$ isoolefins from the distillation column reactor as a first bottoms;

(f) removing unreacted $C_{1-2}$ alcohol and reacted benzene concentrate from the distillation column reactor as a first overheads; and (g) removing the $C_{1-2}$ alcohol from the reacted benzene concentrate. Alternatively the benzene concentrate stream or a portion thereof in step (a) containing benzene, thiophene, linear $C_6$ olefins and $C_6$ isoolefins may be subjected to skeletal isomerization to convert a portion of the linear $C_6$ olefins to $C_6$ isoolefins before feeding to step (b).

A simplified flow diagram of a process for isolating a benzene concentrate useful for use in the present invention is disclosed in FIG. 1. The full boiling range naphtha is fed to a distillation column reactor 10 via flow line 101 and hydrogen is fed via flow line 102. Two beds 12 and 14 of thioetherification catalyst are loaded in the upper end of the distillation column reactor. Both naphtha and hydrogen feeds are below the beds. In the beds diolefins in the naphtha react with mercaptans to form sulfides which are heavier than the material boiling in the beds and thus passes out the bottom of the distillation column reactor along with a heavy naphtha stream in flow line 104. A $C_6$ fraction is withdrawn via flow line 110 and fed to a side stripper 40 wherein $C_5$ and lighter material are stripped and returned to the distillation column 10 via flow line 109.

A light naphtha is taken from the distillation column reactor 10 as overheads via flow line 103 and passed through condenser 20 to receiver 30 via flow line 105. All of the condensed liquid is returned to the distillation column reactor 10 as reflux via flow line 107. The non condensible vapors, including unreacted hydrogen, is removed via flow line 106 and the hydrogen recycled. A light naphtha stream is taken from near the upper end of the column 10 via flow line 108. A heavy naphtha stream is removed as bottoms via flow line 104 for further treatment such as sulfur removal as shown in U.S. Pat. No. 6,444,118.

Figure 2:
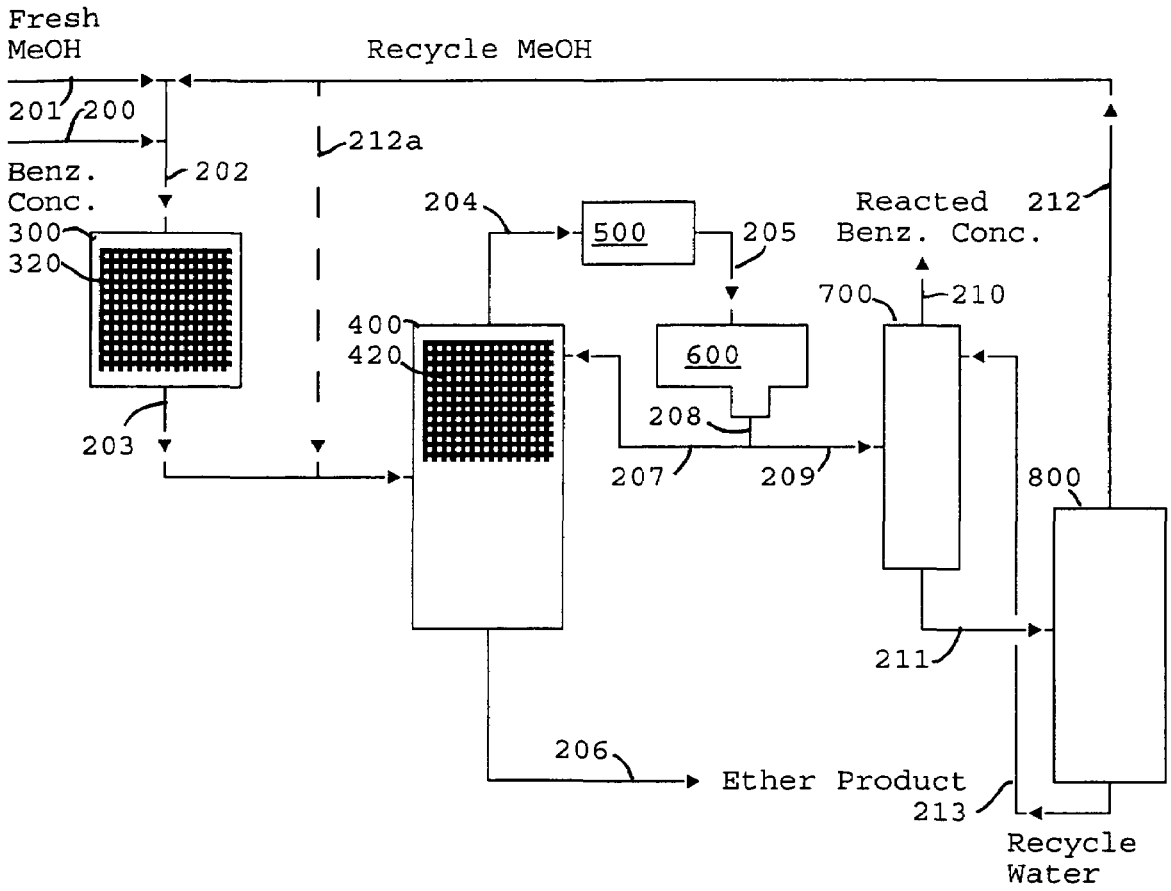
FIG. 2 is a simplified flow diagram in schematic form of a preferred process for etherifying and separating the isoolefins contained in the benzene concentrate.

Referring now to FIG. 2 processing of a benzene concentrate is shown. The benzene concentrate is fed to a fixed bed downflow reactor 300 via flow line 200. Fresh methanol is fed via flow line 201 and the two streams combined in flow line 202. The reactor 300 contains a bed 320 of etherification catalyst such as Amberlyst 15® which is an acidic cation exchange resin. The isoolefins contained in the benzene concentrate stream react with the methanol to form ethers. The formation of the ethers of $C_6$ isoolefins (and other) is strongly limited by equilibrium. The reactor product in flow line 203 is thus fed to a second distillation column reactor 400 containing a bed 420 of etherification catalyst where the remainder of the $C_6$ isoolefins are all essentially converted to methanol ethers of $C_6$ isoolefins. The ethers, being higher boiling than the remainder of the benzene concentrate are removed from the distillation column reactor 400 as bottoms for use in gasoline blending or for further processing.

The reacted benzene concentrate, or raffinate, along with unreacted methanol is withdrawn as overheads from the column 400 via flow line 204 and condensed in condenser 500 and collected in receiver 600. The liquid in the receiver 600 is removed via flow line 208 with a portion of the liquid being returned to the distillation column reactor 400 via flow line 207 as reflux. The benzene concentrate product is removed via flow line 209 and passed to water wash column 700 where the unreacted methanol and water are removed via flow line 211 and fed to methanol/water distillation column 800. Methanol is taken from the distillation column 800 as overheads via flow line 212 and recycled to reactor 300 or distillation column reactor 400 via flow line 212*a*.

The water washed benzene concentrate is removed from the water wash column 700 via flow line 210 and sent to further processing. The benzene concentrate may be subjected to hydrotreating to remove the thiophenes and olefins making it suitable for solvent extraction. In the alternative the stream may be subjected to more severe hydrotreating conditions to hydrogenate the benzene.

The ether product in flow line 206 may be subjected to deetherification in a further reactor (not shown). A catalyst useful for the deetherication reaction comprises a heat stabilized catalyst composition prepared form nuclear sulfonic acid, for example, macroporous crosslinked polyvinyl aromatic compounds containing sulfonic acid groups (Amberlyst 15®, and Amberlyst 35®) having at least 50% of the sulfonic acid groups neutralized with a metal of Al, Fe, Zn, Cu, Ni, ions or mixtures and alkali, alkaline earth metals or ammonium ions by contacting the resin containing the sulfonic acid with aqueous solutions of the metals salts and alkali, alkaline earth metal or ammonium salts. Such a catalyst and process is described in U.S. Pat. No. 4,551,567 which is incorporated herein by reference. This process would be particularly useful where the ether content of gasoline has been limited.

As an alternative the alcohol used may be ethanol. However, the ethanol water mixture would require special handling to overcome the azeotrope. A zeolite based dryer could be utilized in lieu of the alcohol/water column. An azeotropic distillation system could be used utilizing benzene or the reacted benzene concentrate to break the concentrate. The zeolite based dryer would probably have lower operating costs and thus be preferable.

If desired the benzene concentrate can be subjected to skeletal isomerization to increase the iso olefins in the stream which allows for more olefins to be separated. Typical skeletal isomerization operating conditions vary widely but generally are a temperature of from about 450° F. to about 1200° F., a pressure of from about 0 psig to about 150 psig, and a weight hourly space velocity of from about 1.0 h-1 to about 50 h-1. Skeletal isomerization catalyst useful in this invention are known in the art and include zeolites having one-dimensional pore structures with a pore size ranging from greater than about 0.42 nanometers (nm) and less than about 0.7 nm. This type of isomerization process is known. See for example U.S. Pat. Nos. 6,111,160 and 6,323,284 both of which are incorporated by reference. For example in FIG. 2 the benzene concentrate stream 200 can be in whole or in part sent to a skeletal isomerization zone (not shown) where normal olefins are convert to tertiary olefin. This iso olefin enriched steam is them sent to etherification reactor 300, and to finishing etherification in the distillation column reactor 400 thereby recovering more of the olefin from the concentrate.

EXAMPLE

The flow scheme was simulated by a computer program. The ether is represented by ethyl-tertiary-pentyl ether in the simulation since this was the only ether containing seven carbon atoms in the data base. TABLE I below lists typical stream compositions. The simulation reveals several aspects of the invention:

1. the bottoms product from the distillation column reactor 400 contains the ether product and the heavier $C_7$ components.

2. thiophene is recovered predominantly in the reacted benzene concentrate stream where it can be converted in a naphtha downstream hydrotreating unit.

3. of the $C_6$ olefins, approximately half of them are in the iso form (or ⅓ of the olefins if cyclic olefins are included) which represents a significant recovery of olefinic material that will not be subject to saturation in any downstream units.

TABLE I

| w: fraction | Benzene Concentrate | Ether Product | RD Col Overhead | Reacted Benzene | Recycle MeOH |
|---|---|---|---|---|---|
| E-tert-Pet-Ether | 0.00000 | 0.44098 | 0.00000 | 0.00000 | 0.00000 |
| H20 | 0.00000 | 0.00000 | 0.00007 | 0.00670 | 0.00006 |
| methanol | 0.00000 | 0.00000 | 0.03767 | 0.00000 | 0.97462 |
| di-m-ether | 0.00000 | 0.00000 | 0.00008 | 0.00007 | 0.00037 |
| thiophene | 0.00070 | 0.00008 | 0.00106 | 0.00100 | 0.00269 |
| 2-m-thiophene | 0.00010 | 0.00027 | 0.00000 | 0.00000 | 0.00000 |
| 3-m-thiophene | 0.00010 | 0.00027 | 0.00000 | 0.00000 | 0.00000 |
| t-2-pentene | 0.00210 | 0.00000 | 0.00301 | 0.00311 | 0.00016 |
| 2-m-2-butane | 0.00330 | 0.00000 | 0.00474 | 0.00488 | 0.00021 |
| cyclopentene | 0.00340 | 0.00000 | 0.00489 | 0.00504 | 0.00029 |
| 4-m-1-pentene | 0.00210 | 0.00000 | 0.00006 | 0.00006 | 0.00000 |
| 3-m-1-pentene | 0.00320 | 0.00000 | 0.00460 | 0.00474 | 0.00000 |

TABLE I-continued

| w: fraction | Benzene Concentrate | Ether Product | RD Col Overhead | Reacted Benzene | Recycle MeOH |
|---|---|---|---|---|---|
| 23-dim-butane | 0.02100 | 0.00000 | 0.03016 | 0.03114 | 0.00056 |
| 2-m-pentane | 0.08290 | 0.00003 | 0.11905 | 0.12295 | 0.00164 |
| 3-m-pentane | 0.05950 | 0.00008 | 0.08544 | 0.08824 | 0.00112 |
| 2-m-1-pentene | 0.01860 | 0.00000 | 0.00053 | 0.00055 | 0.00001 |
| 1-hexene | 0.01050 | 0.00001 | 0.01508 | 0.01557 | 0.00031 |
| 2-e-1-butene | 0.00690 | 0.00000 | 0.00020 | 0.00020 | 0.00000 |
| n-hexane | 0.03400 | 0.00064 | 0.04851 | 0.05010 | 0.00060 |
| t-3-hexene | 0.04040 | 0.00027 | 0.05793 | 0.05980 | 0.00131 |
| c-3-hexene | 0.00680 | 0.00002 | 0.00976 | 0.01008 | 0.00022 |
| t-2-hexene | 0.01740 | 0.00007 | 0.02497 | 0.02578 | 0.00057 |
| 2-m-2-pentene | 0.04010 | 0.00000 | 0.00115 | 0.00119 | 0.00002 |
| 3-m-cyclopentene | 0.03820 | 0.00002 | 0.05491 | 0.05667 | 0.00188 |
| c-2-hexene | 0.03110 | 0.00030 | 0.04454 | 0.04599 | 0.00090 |
| t-3-m-2-pentene | 0.05500 | 0.00001 | 0.00157 | 0.00162 | 0.00003 |
| m-cyclopentane | 0.12700 | 0.00235 | 0.18128 | 0.18721 | 0.00277 |
| 2-4-dim-pentane | 0.04500 | 0.04078 | 0.04260 | 0.04401 | 0.00021 |
| 1-m-cyclopentene | 0.08140 | 0.00949 | 0.11194 | 0.11554 | 0.00328 |
| cyclohexane | 0.01080 | 0.00391 | 0.01341 | 0.01385 | 0.00022 |
| 2-m-hexane | 0.04720 | 0.12521 | 0.00009 | 0.00009 | 0.00000 |
| 3-m-hexane | 0.03630 | 0.09633 | 0.00005 | 0.00005 | 0.00000 |
| t-1-3-dim-cyclopenta | 0.02830 | 0.07506 | 0.00006 | 0.00006 | 0.00000 |
| n-heptane | 0.00560 | 0.01487 | 0.00000 | 0.00000 | 0.00000 |
| benzene | 0.07000 | 0.00037 | 0.10057 | 0.10369 | 0.00584 |
| toluene | 0.00900 | 0.02390 | 0.00000 | 0.00000 | 0.00000 |
| n-octane | 0.06200 | 0.16468 | 0.00000 | 0.00000 | 0.00000 |

The invention claimed is:

1. An integrated process for the isolation of benzene in a fluid catalytically cracked naphtha stream containing benzene, $C_6$ olefins and $C_6$ isoolefins comprising the steps of:

(a) separating a benzene concentrate fraction containing benzene and the $C_6$ olefins and $C_6$ isoolefins from the naphtha stream;

(b) subjecting the benzene concentrate stream to etherification with an alcohol over an etherification catalyst to convert the $C_6$ isoolefins to ethers; and (c) separating the ethers of $C_6$ isoolefins from the benzene concentrate.

2. The process according to claim 1 wherein said ethers are dissociated to the constituent isoolefins and alcohol.

3. The process according to claim 1 wherein the separated benzene concentrate is subjected to hydrotreating to remove olefins and organic sulfur compounds and the benzene is removed by solvent extraction.

4. The process according to claim 1 wherein the separation of the benzene concentrate is carried out in a distillation column reactor containing a thioetherification catalyst and mercaptans contained within the naphtha are concurrently reacted with diolefins contained within the naphtha to produce sulfides with a light naphtha being removed as overheads, the benzene concentrate being removed as an intermediate stream and a heavy naphtha being removed as bottoms from the distillation column reactor.

5. The process according to claim 1 wherein the alcohol is methanol and the ethers are methanol ethers of $C_6$ isoolefins.

6. The process according to claim 1 wherein the alcohol is ethanol and the ethers are ethanol ethers of $C_6$ isoolefins.

7. An integrated process for the isolation of benzene in a fluid catalytically cracked naphtha stream containing benzene, thiophene, mercaptans, diolefins, $C_6$ olefins and $C_6$ isoolefins comprising the steps of:

(a) separating a benzene concentrate stream containing benzene, thiophene, linear $C_6$ olefins and $C_6$ isoolefins from the fluid catalytically cracked naphtha stream by fractional distillation;

(b) feeding the benzene concentrate stream and methanol to a single pass fixed bed reactor containing an etherification catalyst wherein a portion of the $C_6$ isoolefins are reacted with $C_{1-2}$ alcohol to form ethers of $C_6$ isoolefins;

(c) feeding the effluent from the single pass fixed bed reactor to a distillation column reactor containing a bed of etherification catalyst;

(d) concurrently in the distillation column reactor;

(i) reacting substantially all of the unreacted $C_6$ isoolefins in the effluent with $C_{1-2}$ alcohol to form a reaction mixture containing ethers of $C_6$ isoolefins, unreacted alcohol, and reacted benzene concentrate; and (ii) separating the ethers of $C_6$ isoolefins from unreacted $C_{1-2}$ alcohol and unreacted benzene concentrate by fractional distillation;

(e) removing the ethers of $C_6$ isoolefins from the distillation column reactor as a first bottoms;

(f) removing unreacted $C_{1-2}$ alcohol and reacted benzene concentrate from the distillation column reactor as a first overheads; and (g) removing the $C_{1-2}$ alcohol from the reacted benzene concentrate.

8. The process according to claim 7 wherein the ethers of $C_6$ isoolefins are dissociated to the constituent isoolefins and $C_{1-2}$ alcohol.

9. The process according to claim 7 wherein the $C_{1-2}$ alcohol comprises methanol.

10. The process according to claim 7 wherein the $C_{1-2}$ alcohol comprises ethanol.

11. The process according to claim 7 wherein the separated benzene concentrate is subjected to hydrotreating to remove olefins and organic sulfur compounds and the benzene is removed by solvent extraction.

12. The process according to claim 7 wherein said benzene concentrate stream containing benzene, thiophene, linear $C_6$ olefins and $C_6$ isoolefins is subjected to skeletal isomerization to convert a portion of the linear $C_6$ olefins to $C_6$ isoolefins.

* * * * *